US010020145B2

(12) United States Patent
Geusendam et al.

(10) Patent No.: US 10,020,145 B2
(45) Date of Patent: Jul. 10, 2018

(54) MECHANICAL CONNECTOR AND CIRCUIT BREAKER PROVIDED WITH MECHANICAL CONNECTOR

(71) Applicant: Eaton Industries (Netherlands) B.V., Hengelo (NL)

(72) Inventors: Paulus Geusendam, Hengelo (NL); Gerhardus Leonardus Nitert, Enter (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/535,078

(22) PCT Filed: Dec. 4, 2015

(86) PCT No.: PCT/EP2015/078684
§ 371 (c)(1),
(2) Date: Jun. 12, 2017

(87) PCT Pub. No.: WO2016/091753
PCT Pub. Date: Jun. 16, 2016

(65) Prior Publication Data

US 2017/0330713 A1 Nov. 16, 2017

(30) Foreign Application Priority Data

Dec. 12, 2014 (GB) ..... 1422200.4

(51) Int. Cl.
*H01H 33/66* (2006.01)

(52) U.S. Cl.
CPC . *H01H 33/6606* (2013.01); *H01H 2033/6613* (2013.01)

(58) Field of Classification Search
CPC ..... H01H 33/6606; H01H 2033/6613; H01H 1/38; H01R 13/03; H01R 24/00; H02B 13/005
(Continued)

(56) References Cited

U.S. PATENT DOCUMENTS 3,941,957 A * 3/1976 Tilman ..... H01H 1/38 200/82 R
8,106,321 B2 * 1/2012 Gohler ..... H01H 39/002 200/303
(Continued)

FOREIGN PATENT DOCUMENTS

EP 2398120 A1 12/2011
EP 2654150 A1 10/2013
WO WO 2014067902 A1 5/2014

*Primary Examiner* — Renee Luebke
*Assistant Examiner* — William Bolton
(74) *Attorney, Agent, or Firm* — Leydig, Voit & Mayer, Ltd.

(57) ABSTRACT

A mechanical connector for high and low voltages has a first connector part with a first end having a cavity; a second connector part with a first end having a cross section adapted to the cavity of the first connector part, wherein the inner dimensions of the cavity correspond with the outer dimensions of the cross section to provide a slide fit and an electrical connection between the outer circumference of the cross section and the inner circumference of the cavity; and a thermal conductive, electrically insulating layer is arranged between and in contact with the end face of the second connector part and the bottom of the cavity of the first connector part. A circuit breaker may have such a mechanical connector incorporated in the fixed electrode rod.

7 Claims, 5 Drawing Sheets

(58) Field of Classification Search
USPC ..... 218/139, 118, 123, 140
See application file for complete search history.

(56) References Cited

U.S. PATENT DOCUMENTS

| | | | | |
|---|---|---|---|---|
| 8,353,713 | B2 * | 1/2013 | Hofer | H01R 13/187<br>439/181 |
| 2012/0276755 | A1 * | 11/2012 | Sato | C10M 169/02<br>439/3 |

* cited by examiner

MECHANICAL CONNECTOR AND CIRCUIT BREAKER PROVIDED WITH MECHANICAL CONNECTOR

CROSS-REFERENCE TO RELATED APPLICATIONS

This application is a U.S. national stage application under 35 U.S.C. § 371 of International Application No. PCT/EP2015/078684, filed on Dec. 4, 2015, and claims benefit to British Patent Application No. 1 422 200.4, filed on Dec. 12, 2014. The International Application was published in English on Jun. 16, 2016, as WO 2016/091753 A1 under PCT Article 21(2).

FIELD

The invention relates to a mechanical connector for high and low voltages.

BACKGROUND

In for example a circuit breaker, it is desired to disconnect the circuit breaker, after it has been brought into an open position. To this end, a mechanical connector is arranged in the fixed electrode rod such that the electrode rod can be taken apart into two portions and achieve a disconnected state.

As such circuit breakers are typically intended for high voltages, one needs to ensure, that any transition resistance is minimized. Therefor, the known mechanical connectors have a cavity on one end and a second portion with a cross section corresponding to the shape of the cavity. The second portion is slid into the cavity to connect both portions and electrical contact is achieved via the circumference, which is, considering the electrical fields and current, the optimal path to minimize any transition resistance.

However any heat present in one of the mechanical connector parts is difficult to transfer to the other connector part, as the contact area at the circumference is rather small.

SUMMARY

An aspect of the invention provides a mechanical connector for high and low voltages, comprising: a first connector part including a first end having a cavity; a second connector part including a first end having a cross section adapted to the cavity of the first connector part; and a thermally conductive, electrically insulating layer, arranged between and in contact with the second connector part and the first connector part, wherein inner dimensions of the cavity correspond with outer dimensions of the cross section so as to provide a slide fit and an electrical connection between an outer circumference of the cross section and an inner circumference of the cavity.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
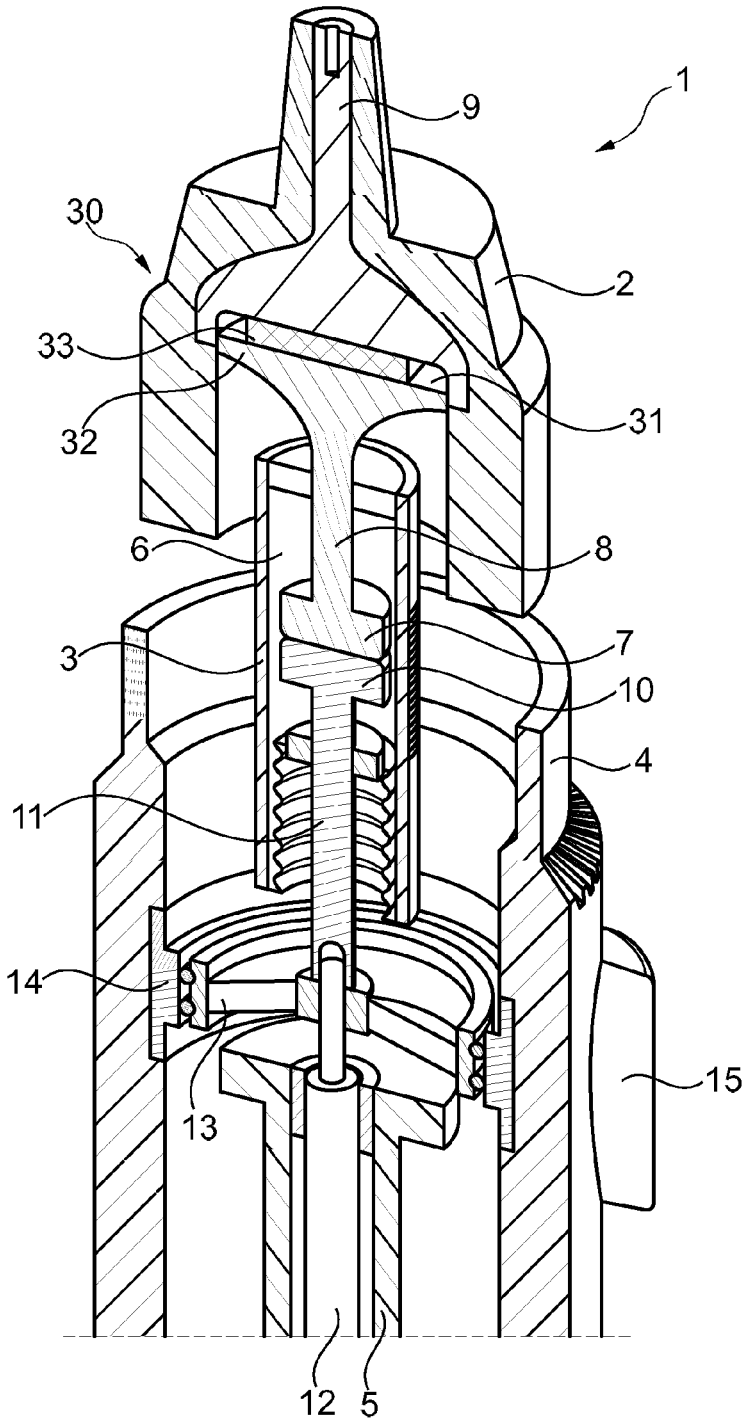
FIG. 1 a perspective cross-sectional view of an embodiment of a circuit breaker according to the invention.

An aspect of the invention provides a mechanical connector for high and low voltages, comprising: a first connector part with a first end having a cavity; a second connector part with a first end having a cross section adapted to the cavity of the first connector part, wherein the inner dimensions of the cavity correspond with the outer dimensions of the cross section to provide a slide fit and an electrical connection between the outer circumference of the cross section and the inner circumference of the cavity.

An aspect of the invention reduces or even removes the above mentioned disadvantages from the Background.

An aspect of the invention provides a mechanical connector including a thermal conductive, electrically insulating layer arranged between and in contact with the second connector part and the first connector part.

Preferably, the thermal conductive, electrically insulating layer is arranged between and in contact with the end face of the second connector part and the bottom of the cavity of the first connector part.

By providing a thermal conductive, electrically insulating layer between the end face of the second connector part and the bottom of the cavity of the first connector part, the full cross section area is used to transfer heat between the first and second connector part. Because the layer is electrically insulating, the path of the electric current is not influenced and therefor remains optimal in view of transition resistance.

In another embodiment of the mechanical connector according to the invention, the thermal conductive, electrically insulating layer is arranged as a sleeve along the cavity wall.

When the first end of the second connector part is inserted into the cavity of the first connector part, the second part will also be brought into contact with the thermal conductive, electrically insulating layer. Especially, when the stroke length when inserting could differ, this will always ensure a sufficient thermal connection between the first connector part and the second connector part. Preferably, the thermal conductive, electrically insulating layer is compressible. This ensures, that when the second connector part is slid into the cavity of the first connector part, a good thermal contact is obtained between both connector parts and the thermal conductive, electrically insulating layer.

An example of a suitable material for the thermal conductive, electrically insulating layer is sold under the trademark Therm-a-gap by Parker Chomerics.

In a preferred embodiment of the mechanical connector according to the invention the cavity is cylindrical and the first end of the second connector part is cylindrical.

The cylindrical shape ensures an even distribution of the electrical current over the mechanical connector and avoids any current concentrations.

In another preferred embodiment of the mechanical connector according to the invention spring means are arranged along the circumference of the first end of the second connector part. The spring means provide a resilient electrical contact surface along the circumference, such that a reliable contact between both connector parts can be achieved. The spring means also ensure, that both parts can easily be slid into engagement.

An aspect of the invention also relates to a circuit breaker comprising:

- a switching device having two contacts movable relative to each other and arranged within an insulation housing;
- a fixed electrode rod mounted on one side of the switching device;
- a movable electrode rod mounted on the other side of the switching device;
- a first terminal arranged on the housing and electrically connected to the fixed electrode rod;
- a second terminal electrically connected with the movable electrode rod; and
- a mechanical connector according to the invention, wherein the mechanical connector is arranged between the fixed electrode rod and the first terminal.

In particular with circuit breakers, a substantial amount of heat is generated in the switching device and for a large portion at the two contacts. The heat can be transferred via the fixed electrode rod, which is in this case mounted to a busbar. However, as a circuit breaker also needs to be able to be positioned into a disconnected state, a mechanical connector, for example an electrical sliding contact, is arranged in the fixed electrode rod.

With a conventional mechanical connector the heat transfer would be disturbed. In case of an electrical sliding contact, this is due to the relative small contact area. However, with the mechanical connector according to the invention, the thermal conductive, electrically insulating layer arranged between both connector parts provides a similar heat transfer path as with a fixed electrode rod without any connectors.

In a further preferred embodiment of the circuit breaker according to the invention the switching device is a vacuum interrupter. Especially with a vacuum interrupter any heat generated at the contacts can only be transferred via the electrode rods.

FIG. 1 shows a perspective cross-sectional view of an embodiment of a circuit breaker 1 according to the invention.

The circuit breaker 1 has an insulation housing 2, 3, 4, 5. A vacuum interrupter 6 is arranged within the insulation housing 2, 3, 4, 5. The vacuum interrupter 6 has a fixed main contact 7 arranged to an electrode rod 8 and electrically connected to a first terminal 9 accessible from the outside of the housing 2, 3, 4, 5.

The vacuum interrupter 6 has further a second, movable, main contact 10, which is arranged on a movable electrode rod 11. The movable rod 11 is operable by an insulated operation pin 12.

The movable electrode rod 11 is furthermore provided with a flexible contact part 13, which is in contact with another contact part 14 to establish an electrical connection between the main contact 10 and the second terminal 15 arranged on the outside of the housing 2, 3, 4, 5.

A mechanical connector 30 is arranged between the electrode rod 8 and the first terminal 9. This mechanical connector has a first connector part, the first terminal 9, with a first end having a cavity 31. A second connector part of the mechanical connector is embodied by the electrode rod 8 with the flanged, disc-like end 32. The cross section of the end 32 is adapted to the inner dimensions of the cavity 31, such that the a slide fit is provided and an electrical connection between the outer circumference of the cross section 32 and the inner circumference of the cavity 31 is established once the disc-like end 32 is slid into the cavity 31. Such a mechanical connector is also known as an electrical sliding contact.

A thermal conductive, electrically insulating layer 33 is arranged between and in contact with the end face 32 of the second connector part 8 and the bottom of the cavity 31 of the first connector part 9.

Figure 2:
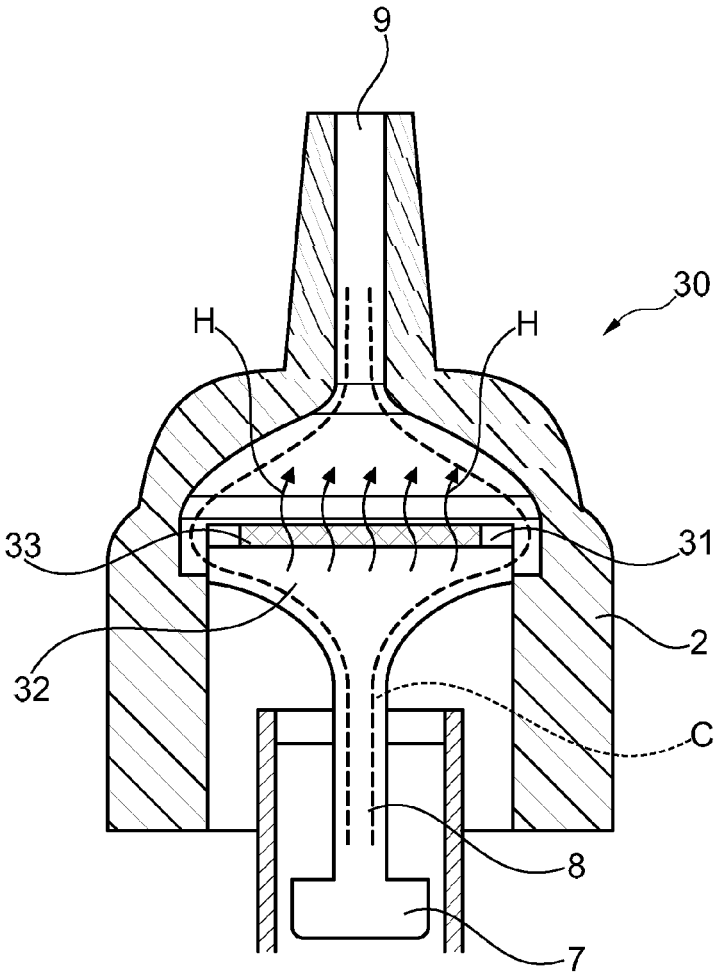
FIG. 2 a more detailed cross-sectional view of the mechanical connector of FIG. 1.

FIG. 2 shows the mechanical connector 30 in more detail. When the disc-like end 32 is slid into the cavity 31, the thermal conductive, electrically insulating layer 33 will be compressed between the first terminal 9 and the electrode rod 8.

Current C will flow via the main contact 7, the circumference of the disc-like end 32, the wall of the cavity 31 and the first connector part. Heat H, which is typically generated at the main contacts 7, 10, will however be able to take advantage of the full surface of the end face 32 and can be transferred via the thermal conductive, electrically insulating layer 33 towards the first terminal 9, which is typically connected to a much cooler busbar.

Figure 3A:
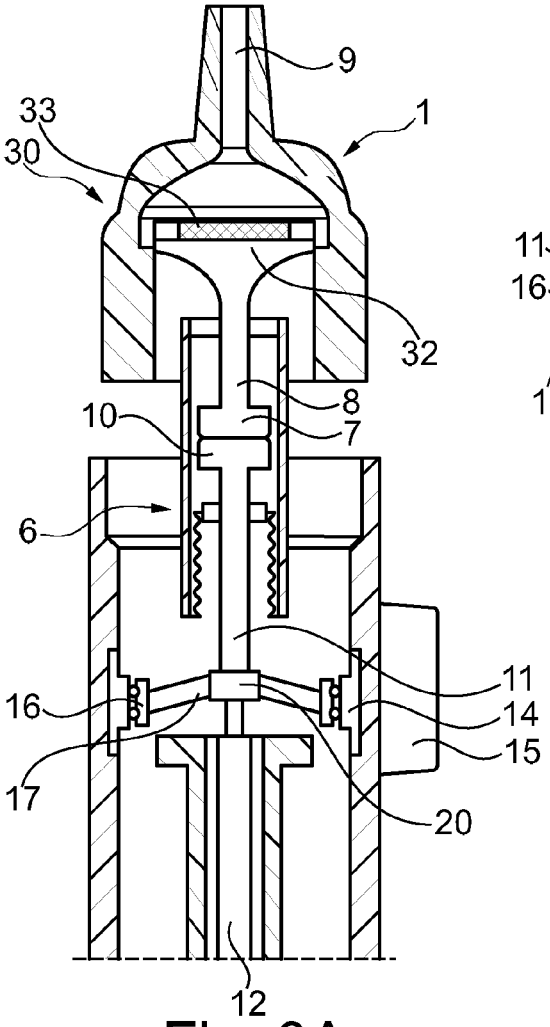
FIGS. 3A-3C the circuit breaker of FIG. 1 in three different positions.

FIG. 3A shows the circuit breaker 1 according to the invention in a closed position. In this position both contacts 7, 10 of the vacuum interrupter 6 are pressed against each other.

The electrode rod 8 is electrically and thermally connected to the first terminal 9 via the mechanical connector 30, while the movable electrode rod 11 is connected to the second terminal 15 via the mounting ring 20, the flexible mounting elements 17, the contact ring 16 and the ring-shaped contact part 14.

Figure 3B:
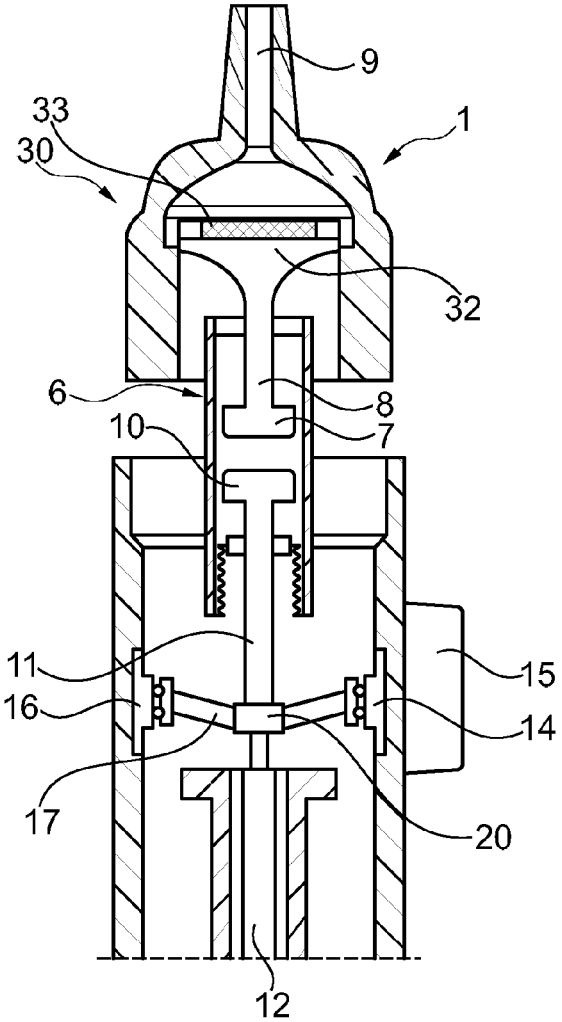

FIG. 3B shows the circuit breaker 1 in an open position in which the operation pin 12 is pulled downward, such that the movable electrode rod 11 is moved down causing the two contacts 7, 10 of the vacuum interrupter to open. Due to the flexibility of the mounting element 17, the movable electrode rod 11 stays in contact with the second terminal 15.

Figure 3C:
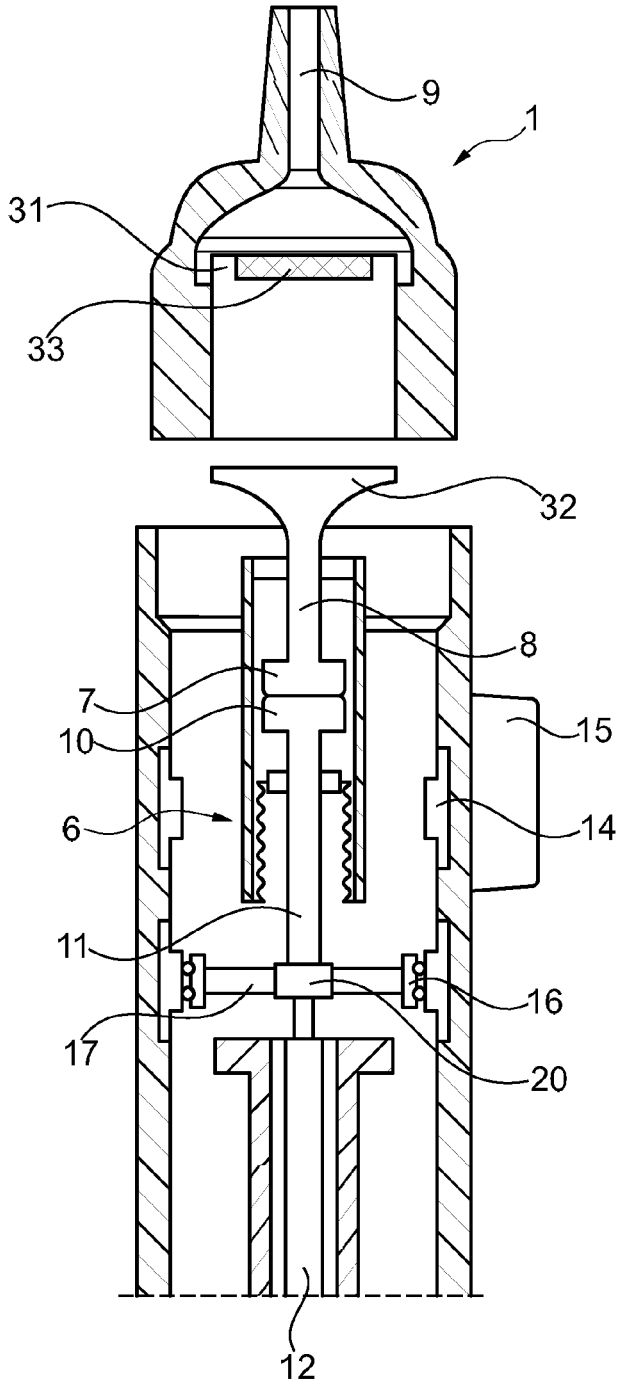

FIG. 3C shows the circuit breaker 1 in disconnected position. In this position, the operation pin 12 is moved further, such that the mechanical connector 30 disconnects and the complete vacuum interrupter 6 is moved downward. As a result, the contact ring 16 will disconnect from the ring-shaped contact part 14, such that the vacuum interrupter 6 is fully disconnected from both the first terminal 9 and the second terminal 15.

Figure 4A:
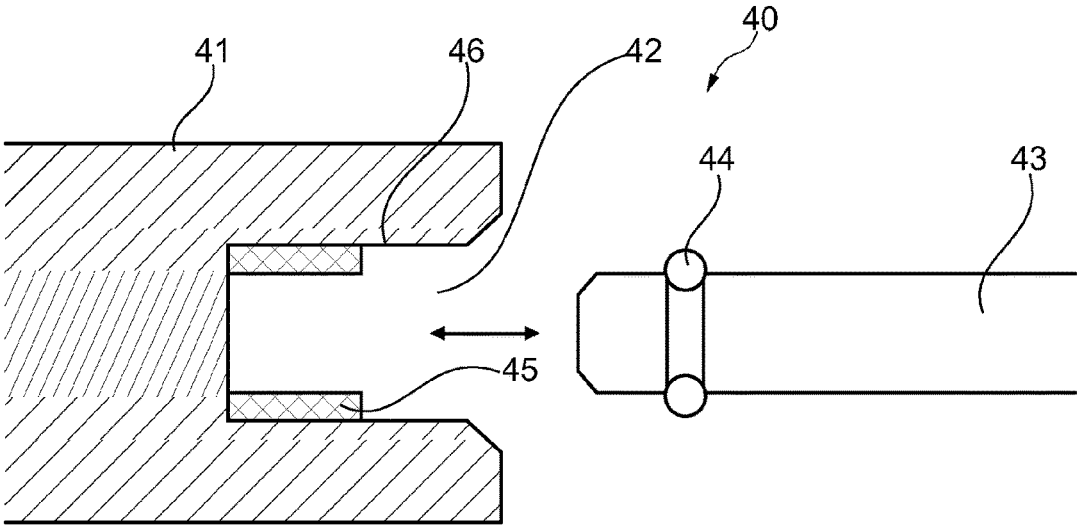
FIGS. 4A-4B a second embodiment of a circuit breaker according to the invention.
Figure 4B:
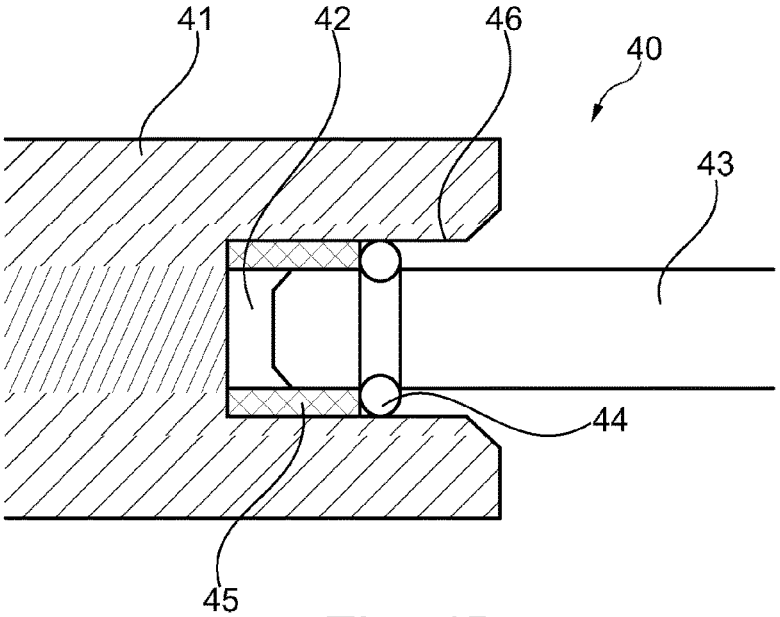

FIGS. 4A and 4B show a second embodiment of a circuit breaker 40 according to the invention in two different positions. The circuit breaker 40 has a first connector part 41 with a cavity 42 and a second connector part 43. The second connector part 43 has at a first end a sliding contact 44. This sliding contact 44 could be for example a ballseal, a multi-contact or a brush contact.

A layer of thermal conductive, electrically insulating material 45 is arranged as a sleeve along the inner wall 46 of the cavity 42.

FIG. 4A shows the circuit breaker 40 in an open positing, while FIG. 4B shows the circuit breaker 40 in a closed position. In this closed position electrical current will flow between the first connector part 41 and the second connector part 43 only via the sliding contact 44, while heat will be exchanged between both connector parts 41, 43 via both the sliding contact 44 and the layer 45 of thermal conductive, electrically insulating material.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A circuit breaker, comprising:

a switching device including a first contact and a second contact, movable relative to each other and arranged within an insulation housing;

a fixed electrode rod mounted on a first side of the switching device;

a movable electrode rod mounted on a second side of the switching device;

a first terminal arranged on the insulation housing and electrically connected to the fixed electrode rod;

a second terminal electrically connected with the movable electrode rod; and a mechanical connector for high and low voltages, the mechanical connector comprising:

a first connector part including a first end having a cavity;

a second connector part including a first end having a cross section adapted to the cavity of the first connector part; and a thermally conductive, electrically insulating layer, arranged between and in contact with the second connector part and the first connector part, wherein inner dimensions of the cavity correspond with outer dimensions of the cross section so as to provide a slide fit and an electrical connection between an outer circumference of the cross section and an inner circumference of the cavity, wherein the mechanical connector is arranged between the fixed electrode rod and the first terminal.

2. The circuit breaker of claim 1, wherein the thermally conductive, electrically insulating layer is arranged between and in contact with an end face of the second connector part and a bottom of the cavity of the first connector part.

3. The circuit breaker of claim 1, wherein the thermally conductive, electrically insulating layer is configured as a sleeve along a wall of the cavity.

4. The circuit breaker of claim 1, wherein the thermally conductive, electrically insulating layer is compressible.

5. The circuit breaker of claim 1, wherein the cavity is cylindrical, and wherein the first end of the second connector part is cylindrical.

6. The circuit breaker of claim 1, further comprising:

a spring arranged along a circumference of the first end of the second connector part.

7. The circuit breaker of claim 1, wherein the switching device comprises a vacuum interrupter.

* * * * *